US007817035B2

(12) United States Patent
Hardacker et al.

(10) Patent No.: US 7,817,035 B2
(45) Date of Patent: Oct. 19, 2010

(54) SYSTEM AND METHOD FOR EFFECTIVELY DETERMINING A PHYSICAL LOCATION OF A REMOTE CONTROL DEVICE

(75) Inventors: Robert Hardacker, Escondido, CA (US); Thomas Dawson, Escondido, CA (US)

(73) Assignees: Sony Corporation, Tokyo (JP); Sony Electronics Inc., Park Ridge, NJ (US)

( * ) Notice: Subject to any disclaimer, the term of this patent is extended or adjusted under 35 U.S.C. 154(b) by 286 days.

(21) Appl. No.: 11/702,739

(22) Filed: Feb. 6, 2007

(65) Prior Publication Data

US 2008/0186176 A1 Aug. 7, 2008

(51) Int. Cl.
*G08B 13/14* (2006.01)

(52) U.S. Cl. ..... 340/568.1; 340/870.09; 340/539.1

(58) Field of Classification Search ..... 340/568.1, 340/566, 546, 870.09, 870.1, 539.32, 825.72, 340/825.36, 825.69, 539.13, 539.15, 825.49, 340/5.61, 571, 539.1, 692
See application file for complete search history.

(56) References Cited

U.S. PATENT DOCUMENTS 5,294,915 A * 3/1994 Owen ..... 340/539.32
6,012,029 A * 1/2000 Cirino et al. ..... 704/275
6,236,358 B1 * 5/2001 Durst et al. ..... 342/357.09
6,445,290 B1 * 9/2002 Fingal et al. ..... 340/539.32
6,535,125 B2 3/2003 Trivett
6,573,833 B1 * 6/2003 Rosenthal ..... 340/539.13
7,323,984 B2 * 1/2008 Chen ..... 340/539.32
2005/0046751 A1 * 3/2005 Simmons ..... 348/734
2006/0109112 A1 * 5/2006 Haines ..... 340/539.32
2007/0097274 A1 * 5/2007 Pfiffer ..... 348/734

* cited by examiner

*Primary Examiner*—Daniel Previl
(74) *Attorney, Agent, or Firm*—Gregory J. Kôerner; Redwood Patent Law

(57) ABSTRACT

A system and method for effectively determining a current physical location of a remote control device includes a television device that is configured to receive television control information over an RC-TV communications link. The remote control device transmits the device control information over the RC-device communications link for controlling various functions of the television device. In situations in which the current physical location of the remote control device is unknown, a system user may initiate a location search procedure with a search trigger event to locate the remote control device. The remote control device then generates one or more location indicators in response to the search trigger event to thereby facilitate determining the current physical location of the remote control device.

46 Claims, 8 Drawing Sheets

110

318

418

SYSTEM AND METHOD FOR EFFECTIVELY DETERMINING A PHYSICAL LOCATION OF A REMOTE CONTROL DEVICE

BACKGROUND SECTION

1. Field of the Invention

This invention relates generally to techniques for locating electronic devices, and relates more particularly to a system and method for effectively determining a physical location of a remote control device.

2. Description of the Background Art

Implementing effective methods for utilizing electronic devices is a significant consideration for designers and manufacturers of contemporary electronic devices. However, effectively utilizing electronic devices may create substantial challenges for system designers. For example, in certain environments that involve portable electronic devices, a system user may periodically misplace a particular electronic device, and may therefore be temporarily unable to utilize the misplaced electronic device until an appropriate search procedure is performed and the particular electronic device is successfully relocated.

In certain time-sensitive situations, the foregoing delay in locating the misplaced electronic device may simply be inconvenient to the system user. However, in certain other types of more critical circumstances and operating environments, an extended time delay and the accompanying inconvenience caused by having to perform a search procedure to locate the misplaced electronic device may potentially result in substantially more serious and detrimental consequences for the system user or other associated parties.

Due the various foregoing factors, it is thus apparent that developing new techniques for utilizing electronic devices in an effective manner is a matter of concern for related electronic technologies. Therefore, for all the foregoing reasons, developing improved techniques for effectively and optimally utilizing electronic devices remains a significant consideration for designers, manufacturers, and users of contemporary electronic devices.

SUMMARY

In accordance with the present invention, a system and method for effectively determining a physical location of an electronic device is disclosed. In one embodiment, a television system includes a remote control, a television, and an optional charging base. The remote control may bi-directionally and wirelessly communicate with the television via a Remote Control-Television (RC-TV) communications link by utilizing any appropriate communication techniques. For example, in certain embodiments, the remote control and the television may directly communicate with each other over the RC-TV communications link by utilizing appropriate low-speed or high-speed radio-frequency (RF) transmission techniques to transfer any desired types of electronic information.

In certain embodiments of the television system, the charging base may optionally be provided for periodically docking and recharging the remote control to ensure uninterrupted control of the television system. The charging base may bi-directionally and wirelessly communicate with the television through a base-TV communications link by utilizing any effective communication techniques. In addition, the charging base may bi-directionally and wirelessly communicate with the remote control through a base-RC communications link by utilizing any effective communication techniques. For example, in certain embodiments, the charging base may directly communicate with the television and the remote control by utilizing appropriate low-speed or high-speed radio-frequency (RF) transmission techniques to transfer any desired types of electronic information.

In certain instances, partially because of the portability and relatively small size of the remote control, a system user may periodically misplace the remote control, and may therefore be temporarily unable to utilize the misplaced remote control until an appropriate search procedure is performed and the remote control is successfully relocated. The present invention provides several improved techniques to facilitate locating such a misplaced remote control.

In certain embodiments, the television system may support a radio-frequency (RF) search procedure in which a system user initially activates an RC locator control on the television. The television may then responsively transmit an RF trigger signal that is received by the misplaced remote control via the RC-TV communications link. In response to the received RF trigger signal, the remote control may then generate an audible locator beacon in any appropriate and effective manner to allow the system user to locate the misplaced remote control by determining the source of the audible locator beacon. In embodiments of the television system that include a charging base, a separate RC locator control may be implemented in the charging base. The foregoing RF search procedure may then be conveniently initiated from the charging base instead of the television.

In certain embodiments, the television system may also support an audible search procedure for locating a missing remote control in which a system user initially provides any appropriate and effective type of audible trigger that is detected by the remote control. For example, in embodiments of the television system in which the remote control includes some basic speech recognition functionality, the system user may create an audible trigger by uttering a pre-determined verbal command. Alternately, the remote control may be implemented with functionality for detecting a specific type of sound, such as an abrupt sound pulse created by the clapping of hands or the striking of an object.

In response to the received audible trigger, the remote control may generate the audible locator beacon in any appropriate and effective manner to allow the system user to locate the misplaced remote control by determining the source of the audible locator beacon. In certain embodiments, the television system may be implemented to perform only the RF search procedure based upon the RF trigger signal, or only the audible search procedure based upon the audible trigger. However, in certain other embodiments, the television system may readily support performing both the RF search procedure and the audible search procedure.

In certain embodiments, the television may be implemented with an antenna assembly to perform an antenna search procedure to locate a misplaced remote control. In accordance with the antenna search procedure, the antenna assembly is implemented to include two or more antennas that are separated by a known separation distance for performing appropriate types of triangulation procedures during the antenna search procedure. The antenna search procedure may be triggered in any effective manner, including by utilizing the RF trigger signal or the audible trigger discussed above.

During the antenna search procedure, the antenna assembly initially transmits an RC locator signal to the remote control via the RC-TV communications link. In response, the misplaced remote control transmits an RC return signal that is received by the antenna assembly of the television via the RC-TV communications link. Depending upon the current location of the remote control with respect to the individual physically-separated antennas of the television, an approximate current location of the remote control may be calculated with triangulation techniques by utilizing such factors as signal strength/quality of the RC return signal at the respective antennas, and/or the propagation delay of the RC return signal at the respective antennas.

In certain embodiments of the television system, a display screen of the television may then present an RC-locator graphical-user-interface (GUI) to present to the system user a graphical representation of the approximate location of the misplaced remote control. The present invention is described above in the context of a television system. However, the concepts and principles of the present invention may be readily utilized for determining the physical location of any suitable type of electronic device. For at least the foregoing reasons, the present invention therefore provides an improved system and method for effectively determining a physical location of a remote control device.

DETAILED DESCRIPTION

The present invention relates to an improvement in electronic systems. The following description is presented to enable one of ordinary skill in the art to make and use the invention, and is provided in the context of a patent application and its requirements. Various modifications to the disclosed embodiments will be readily apparent to those skilled in the art, and the generic principles herein may be applied to other embodiments. Thus, the present invention is not intended to be limited to the embodiments shown, but is to be accorded the widest scope consistent with the principles and features described herein.

The present invention is described herein as a system and method for effectively determining a current physical location of a remote control device, and includes a television device that is configured to receive television control information over an RC-TV communications link. The remote control device transmits the device control information over the RC-device communications link for controlling various functions of the television device. In situations in which the current physical location of the remote control device is unknown, a system user may initiate a location search procedure with a search trigger event to locate the remote control device. The remote control device may then generate one or more location indicator(s) in response to the search trigger event to thereby facilitate determining the current physical location of the remote control device.

Figure 1:
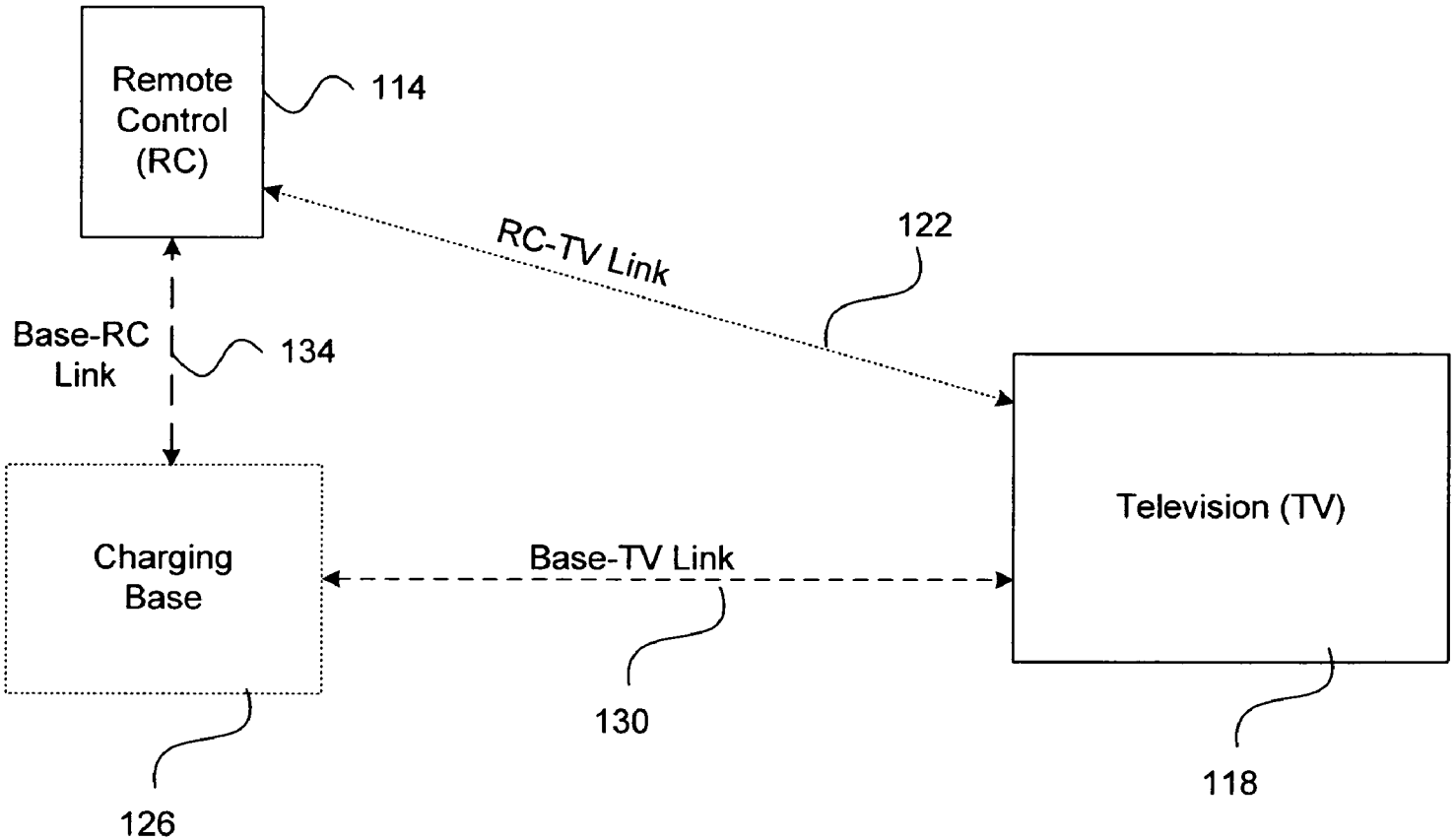
FIG. 1 is a block diagram of a television system, in accordance with one embodiment of the present invention.

Referring now to FIG. 1, a block diagram of a television system 110 is shown, in accordance with one embodiment of the present invention. In the FIG. 1 embodiment, television system 110 may include, but is not limited to, a remote control (RC) 114, a television (TV) 118, and a charging base 126. In alternate embodiments, television system 110 may be implemented using components and configurations in addition to, or instead of, certain of those components and configurations discussed in conjunction with the FIG. 1 embodiment. For example, in certain embodiments, television system 110 may not include charging base 126.

In the FIG. 1 embodiment, remote control 114 may bi-directionally and wirelessly communicate with television 118 via RC-TV link 122 by utilizing any appropriate communication techniques. For example, in certain embodiments, remote control 114 may provide low-speed control information to television 118 by utilizing infrared (IR) transmission techniques. In addition, in certain embodiments, remote control 114 and television 118 may directly communicate with each other over RC-TV link 122 by utilizing appropriate low-speed or high-speed radio-frequency (RF) transmission techniques to transfer any desired types of electronic information.

In certain embodiments of television system 110, charging base 126 may optionally be provided for periodically docking and recharging remote control 114 to ensure uninterrupted control of television 118. In the FIG. 1 embodiment, charging base 126 is supplied with operating power through a local connection to a continuous AC power outlet, instead of through a limited DC battery power source. In the FIG. 1 embodiment, charging base 126 may bi-directionally and wirelessly communicate with television 118 through a base-TV link 130 by utilizing any effective communication techniques. For example, in certain embodiments, charging base 126 and television 118 may directly communicate with each other by utilizing appropriate low-speed or high-speed radio-frequency (RF) transmission techniques to transfer any desired types of electronic information.

In addition, in certain embodiments, charging base 126 may bi-directionally and wirelessly communicate directly with remote control 114 through a base-RC link 134 by utilizing any effective communication techniques. For example, in certain embodiments, charging base 126 and remote control 114 may directly communicate with each other by utilizing appropriate low-speed or high-speed radio-frequency (RF) transmission techniques to transfer any desired types of electronic information. In certain embodiments, charging base 126 may be implemented as a portable device that is flexibly positionable within the operating area of television system 110. In accordance with the present invention, a system user of television 118 may thus selectively locate charging base 126 in a convenient location that is adjacent to at least one typical viewing location from which the system user views and otherwise utilizes television system 110. The system user may then readily access the various functionalities of charging base 126 from the comfort and convenience of the system user's typical viewing location.

In certain instances, partially because of the portability and relatively small size of remote control 114, a system user may periodically misplace remote control 114, and may therefore be temporarily unable to utilize the misplaced remote control 114 until an appropriate search procedure is performed and remote control 114 is successfully relocated. The present invention provides several improved techniques to facilitate advantageously locating such a misplaced remote control 114.

In the FIG. 1 embodiment, television system 110 may support a radio-frequency (RF) search procedure in which a system user initially activates an RC locator control on television 118. Television 118 may then responsively transmit an RF trigger signal that is received by the misplaced remote control 114 via RC-TV link 122. In certain embodiments, the RF trigger signal is transmitted in an omni-directional manner to ensure optimal reception by remote control 114. In response to the received RF trigger signal, remote control 114 may then generate an audible locator beacon in any appropriate and effective manner to allow the system user to locate the misplaced remote control 114 by determining the source of the audible locator beacon.

In embodiments of television system 110 that include a charging base 126, a separate RC locator control may be implemented in charging base 126. The foregoing RF search procedure may then be conveniently initiated from charging base 126 instead of television 118. If the system user utilizes charging base 126 to initiate a RF search procedure, then charging base 126 may provide an RF trigger signal directly to remote control 114 via base-RC link 134 to initiate the RF search procedure. Alternately, charging base 126 may provide the RF trigger signal to television 118 via base-TV link 130, and television 118 may then relay the RF trigger signal to remote control 114 via RC-TV link 122.

In certain embodiments, television system 110 may alternately support an audible search procedure for locating a missing remote control 114 in which a system user initially provides any appropriate and effective type of audible trigger that is detected by remote control 114. For example, in embodiments of television system 110 in which remote control 114 includes some basic speech recognition functionality, the system user may create an audible trigger by uttering a pre-determined verbal command. Alternately, remote control 114 may be implemented with functionality for detecting a specific type of sound, such as an abrupt sound pulse created by the clapping of hands or the striking of an object, etc.

In response to the received audible trigger, remote control 114 may generate the audible locator beacon in any appropriate and effective manner to allow the system user to locate the misplaced remote control 114 by determining the source of the audible locator beacon. In certain embodiments, television system 110 may be implemented to perform only the RF search procedure based upon the RF trigger signal, or only the audible search procedure based upon the audible trigger. However, in certain other embodiments, television system 110 may readily support performing both the RF search procedure and the audible search procedure either concurrently or sequentially.

In certain embodiments, television 118 may be implemented with an antenna assembly to perform an antenna search procedure to locate a misplaced remote control 114. In accordance with the antenna search procedure, the antenna assembly is implemented to include two or more antennas that are separated by a known separation distance for performing appropriate types of triangulation procedures during the antenna search procedure. The antenna search procedure may be triggered in any effective manner, including by utilizing the RF trigger signal or the audible trigger that were discussed above.

During the antenna search procedure, the antenna assembly initially transmits an RC locator signal to remote control 114 via RC-TV link 122. In response, the misplaced remote control 114 transmits an RC return signal that is received by the antenna assembly of television 118 via RC-TV link 122. Depending upon the current location (distance) of remote control 114 with respect to the individual physically-separated antennas of television 118, an approximate current location of remote control 114 may be calculated with known triangulation techniques by utilizing such factors as signal strength/quality of the RC return signal at the respective antennas, and/or the propagation delay of the RC locator signal and RC return signal (from the transmit time that the RC locator signal is transmitted by television 118 until the individual receive times that the RC return signal is received by the respective antennas).

In certain embodiments of television system 110, a display screen of television 118 may then advantageously present an RC-locator graphical-user-interface (GUI) to present to the system user a graphical representation of the approximate location of the misplaced remote control 114. The foregoing RC locator GUI is further discussed below in conjunction with FIG. 8. The FIG. 1 embodiment of the present invention is described in the context of television system 110. However, the concepts and principles of the present invention may be readily utilized for determining the physical location of any suitable type of electronic device. The implementation and utilization of the FIG. 1 television system 110 is further discussed below in conjunction with FIGS. 2-8.

Figure 2:
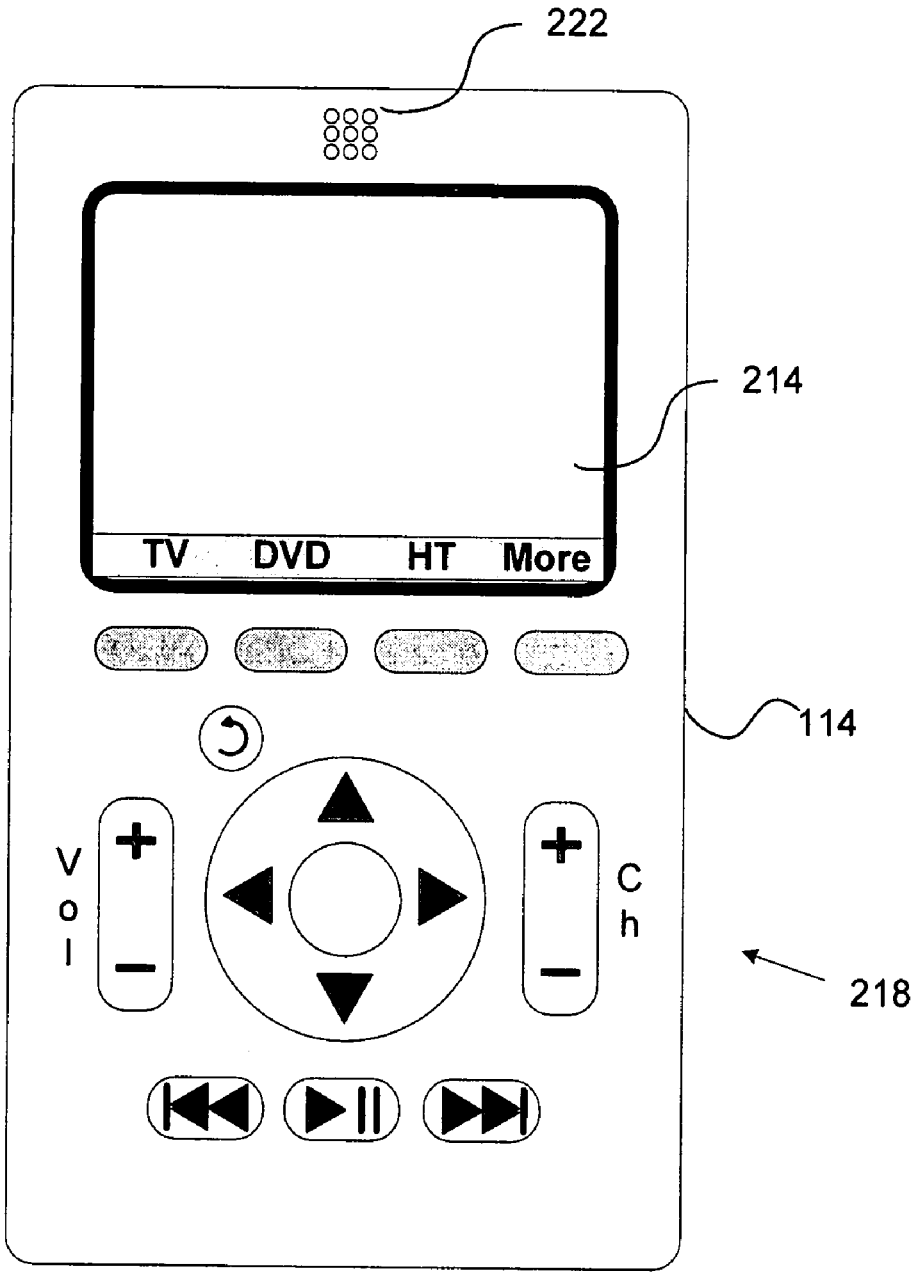
FIG. 2 is a diagram of the remote control of FIG. 1, in accordance with one embodiment of the present invention.

Referring now to FIG. 2, a diagram of the FIG. 1 remote control 114 is shown, in accordance with one embodiment of the present invention. The FIG. 2 embodiment is presented for purposes of illustration, and in alternate embodiments, remote control 114 may be implemented using components and configurations in addition to, or instead of, certain of those components and configurations discussed in conjunction with the FIG. 2 embodiment.

In the FIG. 2 embodiment, remote control 114 includes an LCD 214 for displaying appropriate information to a system user. In the FIG. 2 embodiment, remote control 114 also includes a control button array 218 to permit the system user to provide control information to television system 110 (FIG. 1). In certain embodiments, control button array 218 may include any effective means for turning off an audible locator beacon that has been activated by an RC search procedure, as discussed above in conjunction with FIG. 1. In the FIG. 2 embodiment, remote control 114 may include a transducer 222 that may both receive and transmit audible sound information for remote control 114. In alternate embodiments, transducer 222 may be implemented as a separate microphone device and a separate speaker device. Additional details for the implementation of remote control 114 are further discussed below in conjunction with FIGS. 4 and 6.

Figure 3:
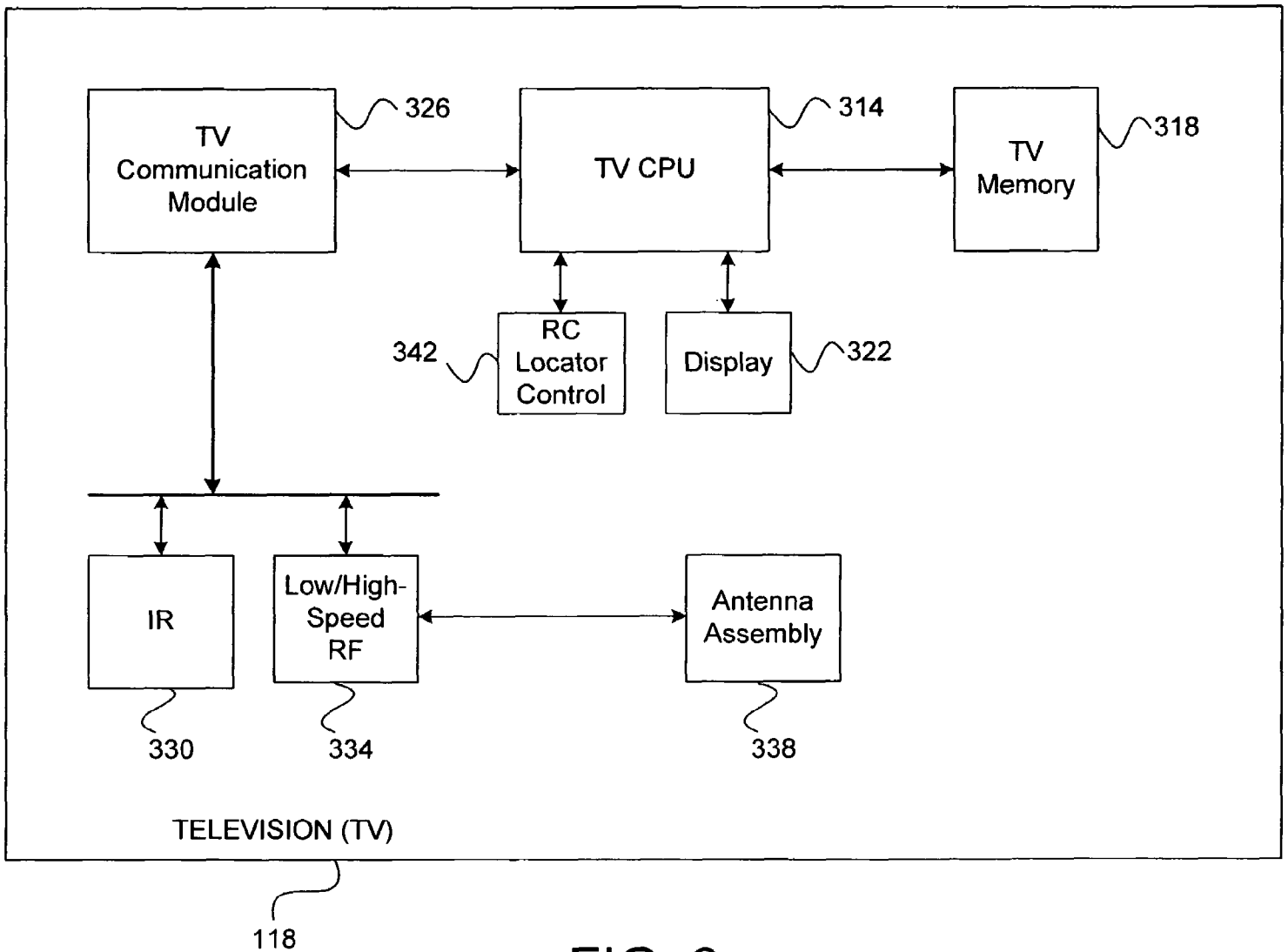
FIG. 3 is a block diagram for one embodiment of the television of FIG. 1, in accordance with the present invention.

Referring now to FIG. 3, a block diagram for one embodiment of the FIG. 1 television 118 is shown, in accordance with the present invention. In alternate embodiments, television 118 may include components and configurations in addition to, or instead of, certain of those components and configurations discussed in conjunction with the FIG. 3 embodiment.

In the FIG. 3 embodiment, television 118 includes a TV central processing unit (TV CPU) 314 that may be implemented to include any appropriate and compatible microprocessor device. In the FIG. 3 embodiment, TV CPU 314 preferably executes software instructions from one or more software programs to thereby control and manage the operation of television 118. In the FIG. 3 embodiment, TV memory 318 may be implemented to include any combination of desired storage devices, including, but not limited to, read-only memory (ROM), random-access memory (RAM), and various types of non-volatile memory, such as floppy disks or hard disks. TV memory 318 is further discussed below in conjunction with FIG. 5.

In the FIG. 3 embodiment, television 118 includes a TV communication module 326 that cooperates with TV CPU 314 to perform and coordinate various types of bi-directional wireless and wired communications between television 118 and other entities. The FIG. 3 embodiment also includes a series of TV input/output interfaces that TV communication module 326 may utilize to receive and/or transmit any required types of information. For example, in the FIG. 3 embodiment, the TV input/output interfaces include, but are not limited to, an infrared (IR) interface 330 and a low/high-speed radio frequency (RF) interface 334.

In the FIG. 3 embodiment, TV communication module 326 may utilize IR interface 330 to receive control information and other appropriate information from remote control 114 (FIG. 1) by utilizing any effective infrared transmission techniques. In the FIG. 3 embodiment, TV communication module 326 may utilize low/high-speed RF interface 334 to bi-directionally and wirelessly communicate with remote control 114 (FIG. 1) through antenna assembly 338 by utilizing any effective RF transmission techniques at any appropriate frequencies. For example, in the FIG. 3 embodiment, the high-speed RF transmissions may operate in the approximate range of 100 megabits-per-second.

In certain embodiments, TV communication module 326 may also utilize low/high-speed RF interface 334 to bi-directionally communicate directly with charging base 126. In the FIG. 3 embodiment, television 118 includes an RC locator control 342 that a system user may utilize to initiate an RF search procedure to located a misplaced remote control 114 by transmitting an RF trigger signal to the remote control 114, as discussed above in conjunction with FIG. 1. In certain embodiments, RC locator control 342 may include a simple search activation button.

In the FIG. 3 embodiment, as discussed above in conjunction with FIG. 1, a system user of television system 110 may utilize antenna assembly 338 to perform an antenna search procedure to locate a misplaced remote control 114. The antenna assembly 338 may include two or more discrete antennas that are separated by a known separation distance for performing appropriate types of triangulation procedures during the antenna search procedure. During the antenna search procedure, the antenna assembly initially transmits an RC locator signal to remote control 114 via RC-TV link 122. In response, the misplaced remote control 114 transmits an RC return signal that is received by the antenna assembly of television 118 via RC-TV link 122.

Depending upon the current location (distance) of remote control 114 with respect to the individual physically-separated antennas of antenna assembly 338, an approximate current location of remote control 114 may be calculated with known triangulation techniques by utilizing such factors as signal strength/quality of the RC return signal at the respective antennas, and/or the propagation delay of the RC locator signal and RC return signal. The implementation and utilization of television 118 are further discussed below in conjunction with FIGS. 5 and 8.

Figure 4:
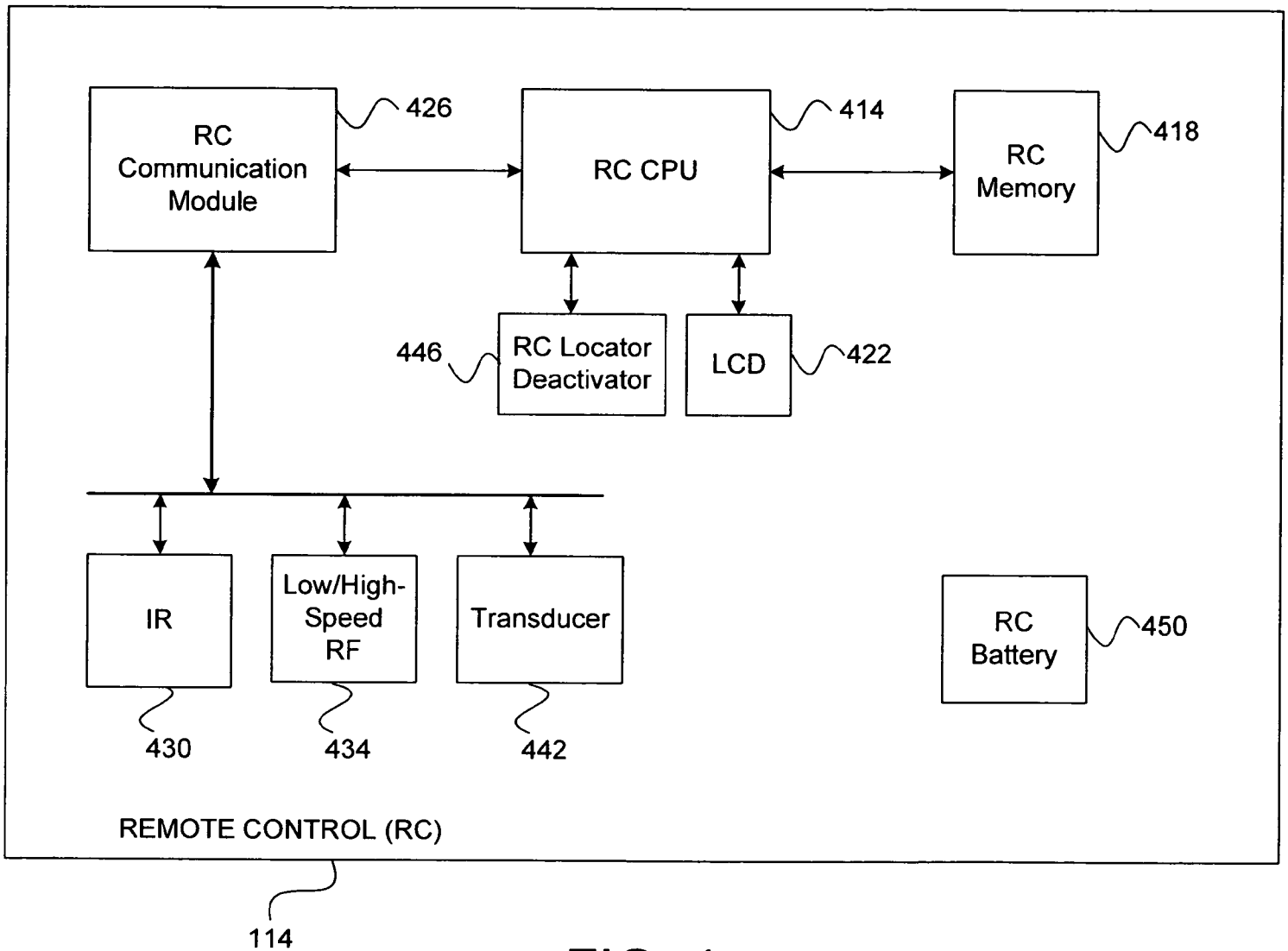
FIG. 4 is a block diagram for one embodiment of the remote control of FIG. 1, in accordance with the present invention.

Referring now to FIG. 4, a block diagram for one embodiment of the FIG. 1 remote control (RC) 114 is shown, in accordance with the present invention. In alternate embodiments, remote control 114 may include components and configurations in addition to, or instead of, certain of those components and configurations discussed in conjunction with the FIG. 4 embodiment.

In the FIG. 4 embodiment, remote control 114 includes a remote control central processing unit (RC CPU) 414 that may be implemented to include any appropriate and compatible microprocessor device. In the FIG. 4 embodiment, RC CPU 414 preferably executes software instructions from one or more software programs to thereby control and manage the operation of remote control 114. In the FIG. 4 embodiment, RC memory 418 may be implemented to include any combination of desired storage devices, including, but not limited to, read-only memory (ROM), random-access memory (RAM), and various types of non-volatile memory. The implementation and utilization of RC memory 418 are further discussed below in conjunction with FIG. 6.

In the FIG. 4 embodiment, remote control 114 includes an RC communication module 426 that cooperates with RC CPU 414 to perform and coordinate various types of bi-directional wireless and wired communications between remote control 114 and other entities. The FIG. 4 embodiment also includes a series of RC input/output interfaces that RC communication module 426 may utilize to receive and/or transmit any required types of information. For example, in the FIG. 4 embodiment, the RC input/output interfaces include, but are not limited to, an infrared (IR) interface 430, a low/high-speed radio frequency (RF) interface 434, and a transducer 442.

In the FIG. 4 embodiment, RC communication module 426 may utilize IR interface 430 to send control information and other appropriate information directly to television 118 (FIG. 1) by utilizing any effective infrared transmission techniques. In the FIG. 4 embodiment, RC communication module 426 may utilize low/high-speed RF interface 434 to bi-directionally and wirelessly communicate with television 118 by utilizing any effective RF transmission techniques at any appropriate low or high RF frequencies. In addition, in the FIG. 4 embodiment, remote control 114 may utilize low/high-speed RF interface 434 to bi-directionally and wirelessly communicate with charging base 126 (FIG. 1) by utilizing any effective RF transmission techniques at any appropriate low or high RF frequencies.

In the FIG. 4 embodiment, RC communication module 426 may utilize transducer 442 to both convert audible sounds into electrical signals and to convert electrical signals into audible sounds. In alternate embodiments, transducer 222 may be implemented as a separate microphone device and a separate speaker device. In the FIG. 4 embodiment, remote control 114 may include a rechargeable RC battery 450 that may advantageously be recharged by charging base 126 (FIG. 1) when remote control 114 is docked to charging base 126. In the FIG. 4 embodiment, remote control 114 includes an RC locator deactivator 446 that a system user may utilize to terminate an audible locator beacon, as discussed above in conjunction with FIG. 1. In certain embodiments, RC locator deactivator 446 may include a simple deactivation button. Techniques for effectively locating a misplaced remote control 114 are further discussed below in conjunction with FIGS. 5-8.

Figure 5:
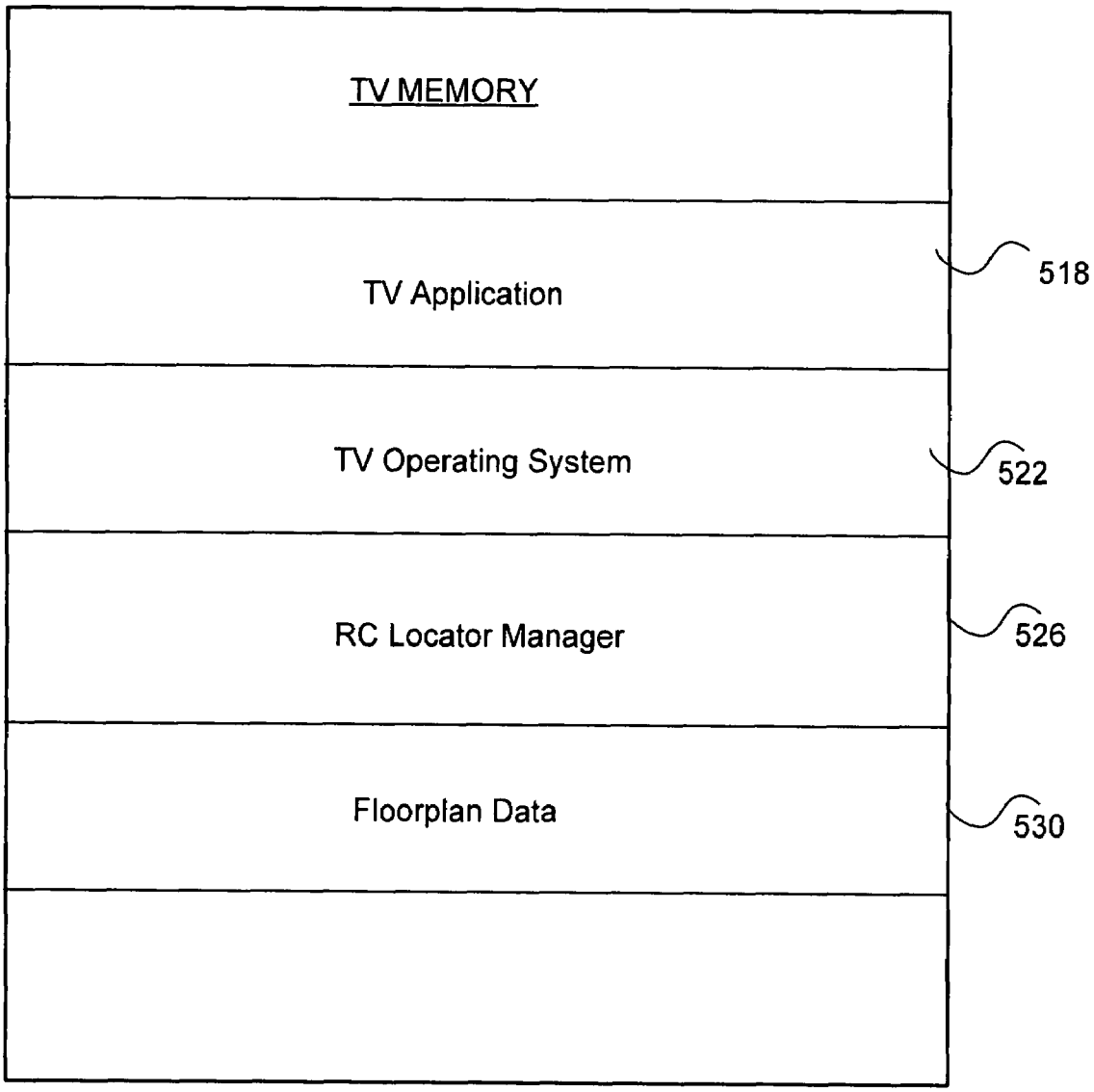
FIG. 5 is a block diagram of a TV memory from the television of FIG. 1, in accordance with one embodiment of the present invention.

Referring now to FIG. 5, a block diagram of a TV memory 514 from FIG. 1 television 118 is shown, in accordance with one embodiment of the present invention. In the FIG. 5 embodiment, TV memory 514 includes, but is not limited to, a TV application 518, a TV operating system 522, an RC locator manager 526, and floorplan data 530. The FIG. 5 embodiment is presented for purposes of illustration, and in alternate embodiments, TV memory 514 may be implemented using components and configurations in addition to, or instead of, certain of those components and configurations discussed in conjunction with the FIG. 5 embodiment.

In the FIG. 5 embodiment, TV memory 318 stores a TV application 518 which includes program instructions that are executed by TV CPU 314 (FIG. 3) to perform various functions and operations for television 118. The particular nature and functionality of TV application 518 typically varies depending upon factors such as the specific type and functionality of the corresponding television 118. In the FIG. 5 embodiment, TV memory 318 may also store a TV operating system 522 that controls and coordinates low-level functionality of television 118.

In the FIG. 5 embodiment, TV memory 318 may also include an RC locator manager 526 with program instructions that TV CPU 314 may execute to support various remote control search procedures to effectively locate a misplaced remote control 114, as discussed above in conjunction with FIG. 1. In addition, in certain embodiments of the present invention, TV memory 318 may store floorplan data 530 for displaying a floorplan of surrounding areas that are adjacent to television system 110. RC locator manager 526 may then display an approximate location marker on the displayed floorplan to assist the system user in determining the current location of a misplaced remote control 114. Various techniques for effectively locating remote control 114 are further discussed below in conjunction with FIGS. 6-8.

Figure 6:
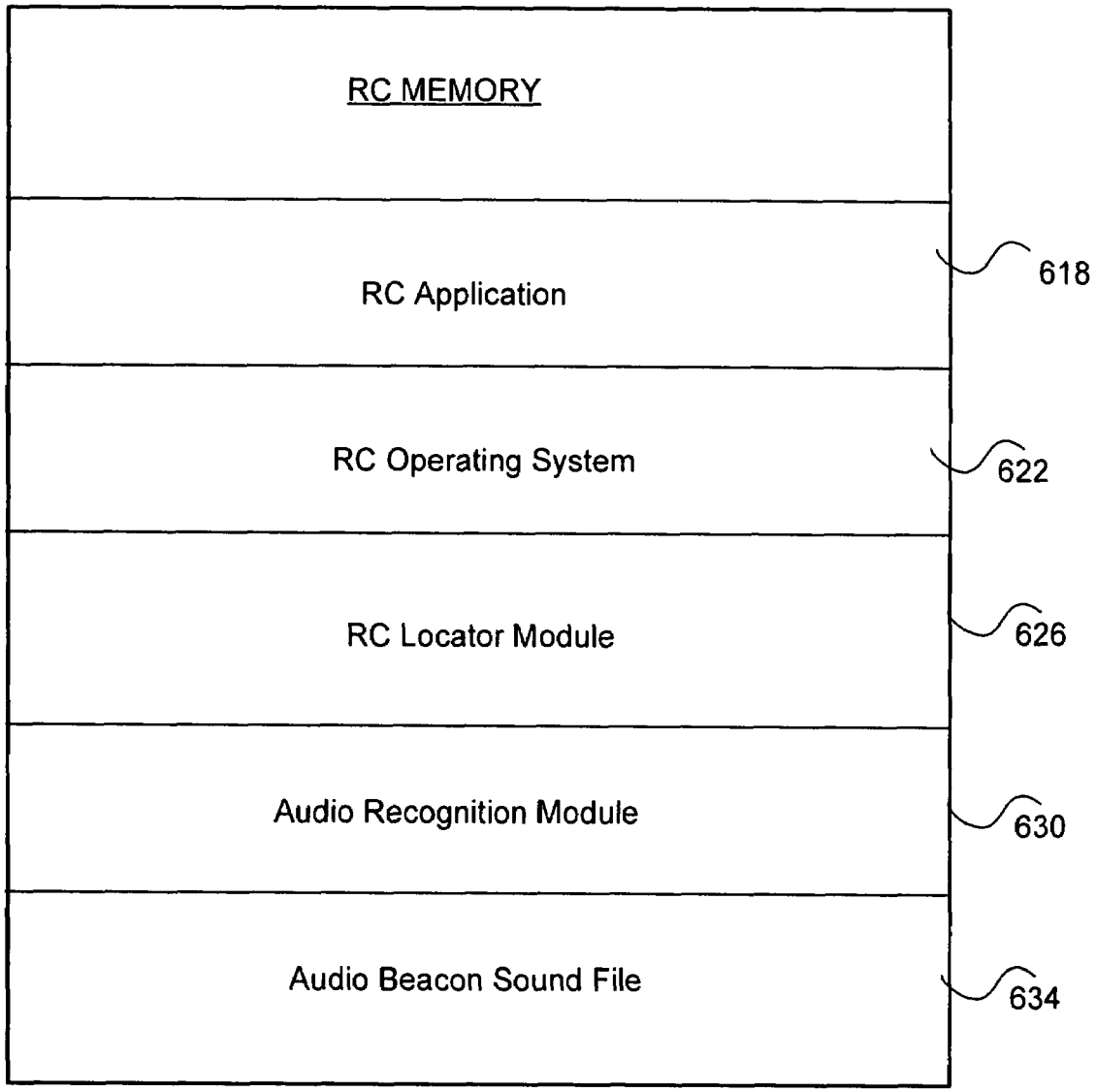
FIG. 6 is a block diagram of an RC memory from the remote control of FIG. 1, in accordance with one embodiment of the present invention.

Referring now to FIG. 6, a block diagram of an RC memory 614 from FIG. 1 remote control 114 is shown, in accordance with one embodiment of the present invention. In the FIG. 6 embodiment, RC memory 614 includes, but is not limited to, an RC application 618, an RC operating system 622, an RC locator module 626, an audio recognition module 630, and an audio beacon sound file 634. The FIG. 6 embodiment is presented for purposes of illustration, and in alternate embodiments, RC memory 614 may be implemented using components and configurations in addition to, or instead of, certain of those components and configurations discussed in conjunction with the FIG. 6 embodiment.

In the FIG. 6 embodiment, RC memory 418 stores an RC application 618 which includes program instructions that are executed by RC CPU 414 (FIG. 4) to perform various functions and operations for remote control 114. The particular nature and functionality of RC application 618 typically varies depending upon factors such as the specific type and functionality of the corresponding remote control 114. In the FIG. 6 embodiment, RC memory 418 may also store an RC operating system 622 that controls and coordinates low-level functionality of remote control 114.

In the FIG. 6 embodiment, RC memory 418 may also include an RC locator module 626 with program instructions that RC CPU 414 may execute to support various remote control search procedures to effectively locate a misplaced remote control 114, as discussed above in conjunction with FIG. 1. In addition, in certain embodiments of the present invention, RC memory 418 may include an audio recognition module 630 that detects an audible trigger for initiating a corresponding search procedure to locate a misplaced remote control 114.

For example, audio recognition module 630 may include speech recognition functionality so that a system user may provide an audible trigger to initiate a remote control search procedure by uttering a pre-determined verbal command. Alternately, audio recognition module 630 may be implemented with functionality for detecting a specific type of sound, such as an abrupt sound pulse created by the clapping of hands or the striking of an object, etc. For example, audio recognition module 630 may identify an audible trigger event by comparing digitized sounds captured by transducer 442 (FIG. 4) with one or more locally stored digital sound files. In the FIG. 6 embodiment, RC memory 418 may also store one or more audio beacon sound files that remote control 114 may reproduce through transducer 442 to permit a system user to aurally locate the current location of a misplaced remote control 114. Various techniques for effectively locating remote control 114 are further discussed below in conjunction with FIGS. 7-8.

Figure 7:
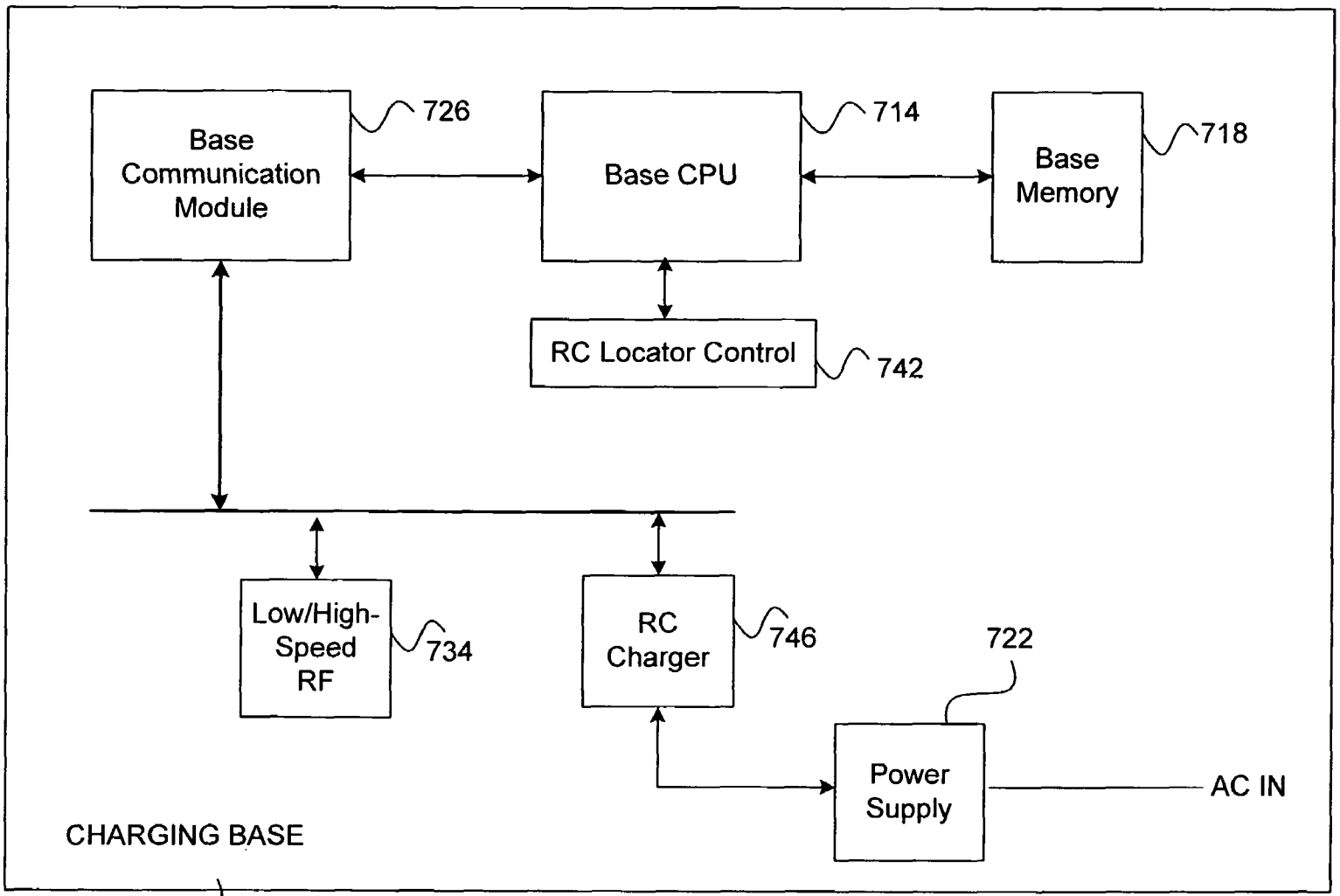
FIG. 7 is a block diagram for one embodiment of the charging base of FIG. 1, in accordance with the present invention.

Referring now to FIG. 7, a block diagram for one embodiment of the FIG. 1 charging base 126 is shown, in accordance with the present invention. In alternate embodiments, charging base 126 may include components and configurations in addition to, or instead of, certain of those components and configurations discussed in conjunction with the FIG. 7 embodiment.

In the FIG. 7 embodiment, charging base 126 includes a base central processing unit (base CPU) 714 that may be implemented to include any appropriate and compatible microprocessor device. In the FIG. 7 embodiment, base memory 718 may be implemented to include any combination of desired storage devices, including, but not limited to, read-only memory (ROM), random-access memory (RAM), and various types of non-volatile memory. In the FIG. 7 embodiment, base memory 718 stores one or more application programs and other software modules that include program instructions that are executed by base CPU 714 to perform various functions and operations for charging base 126. The particular nature and functionality of application programs typically varies depending upon factors such as the specific type and functionality of the corresponding charging base 126. In the FIG. 7 embodiment, base memory 718 may also store a base operating system that controls and coordinates low-level functionality of charging base 126.

In the FIG. 7 embodiment, charging base 126 includes a base communication module 726 that cooperates with base CPU 714 to perform and coordinate various types of bi-directional wireless and/or wired communications between charging base 126 and other entities. In the FIG. 7 embodiment, base communication module 726 may utilize a low/high-speed RF interface 734 to bi-directionally and wirelessly communicate with television 118, remote control 114, or other external entities by utilizing any effective. RF transmission techniques at any appropriate RF frequencies. For example, in the FIG. 7 embodiment, the high-speed RF transmissions may operate in the approximate range of 100 megabits-per-second. In the FIG. 7 embodiment, charging base 126 includes an RC locator control 742 that a system user may utilize to initiate an RF search procedure to located a misplaced remote control 114 by transmitting an RF trigger signal to the remote control 114, as discussed above in conjunction with FIG. 1. In certain embodiments, RC locator control 742 may include a simple activation button. Furthermore, in the FIG. 7 embodiment, a power supply 722 of charging base 126 may be connected to a continuous AC power source (AC IN) for providing an RC recharging power source to RC charger 746 to thereby recharge an RC battery 450 (FIG. 4) of a docked remote control 114.

Figure 8:
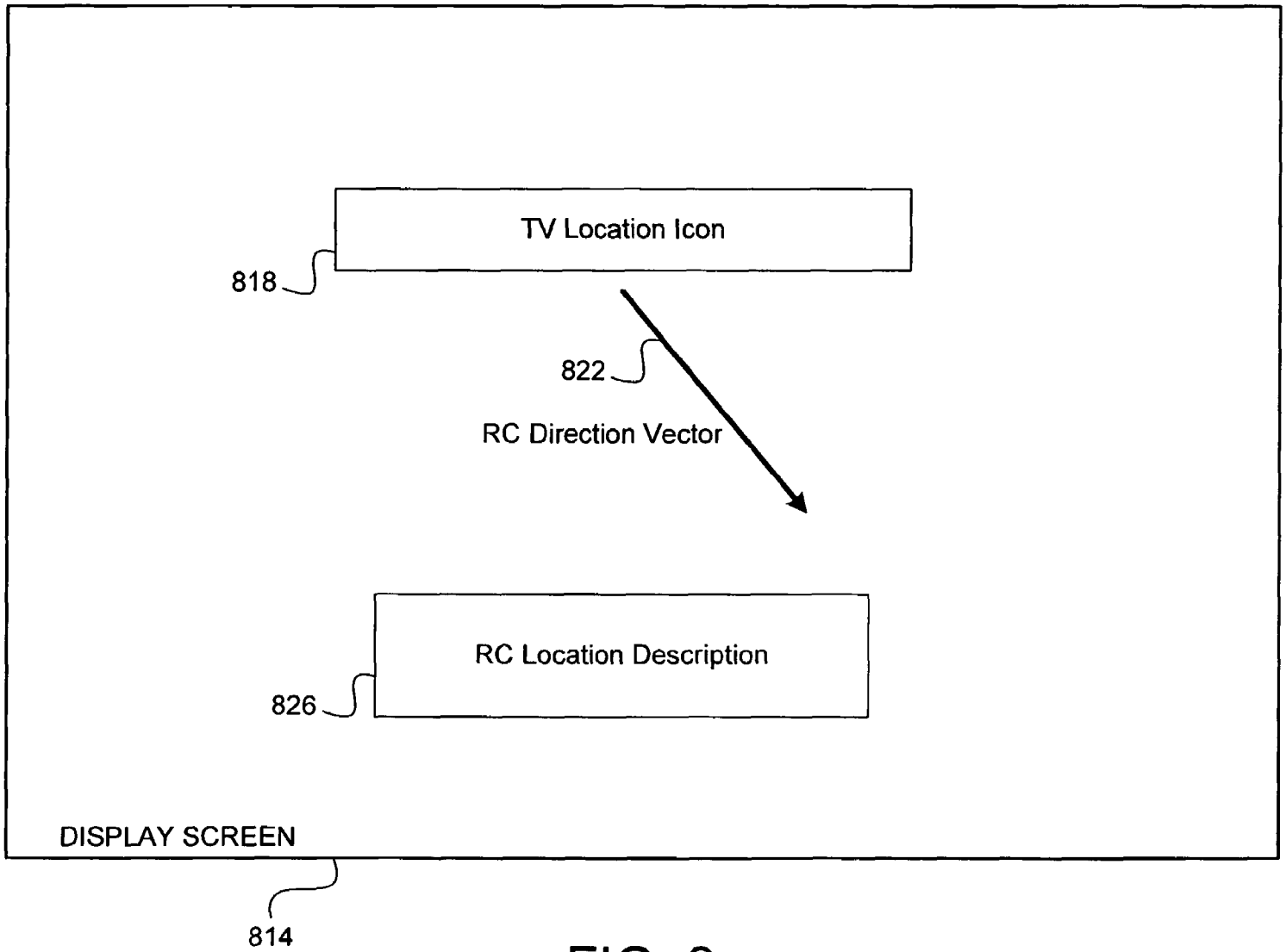
FIG. 8 is a diagram of an RC locator graphical-user-interface, in accordance with one embodiment of the present invention.

Referring now to FIG. 8, a diagram of an RC locator graphical-user-interface (RC locator GUI) 814 is shown, in accordance with one embodiment of the present invention. The FIG. 8 embodiment is presented for purposes of illustration, and in alternate embodiments, RC locator GUI 814 may be implemented using components and configurations in addition to, or instead of, certain of those components and configurations discussed in conjunction with the FIG. 8 embodiment.

In the FIG. 8 embodiment, RC locator GUI 814 may advantageously be generated upon a display screen of television 118 for visually presenting to a system user a graphical representation showing the approximate location of a misplaced remote control 114. In certain embodiments, television 118 may create RC locator GUI 814 after performing an antenna search procedure to determine the current physical location of remote control 114, as discussed above in conjunction with FIG. 1.

In the FIG. 8 embodiment, RC locator GUI 814 is presented as a plan view of the viewing location of television system 110, and includes a TV location icon 818 that represents the approximate location of television 118 (FIG. 1). In addition, RC locator GUI 814 includes an RC direction vector 822 that shows the approximate current direction of the misplaced remote control 114 with reference to television 118 (as represented by TV location icon 818). Furthermore, in certain embodiments, RC locator GUI 814 has an RC location description 826 that may include written text that specifies the current location (distance and/or direction) of the misplaced remote control 114 with reference to television 118. In certain embodiments, RC locator GUI 814 may be superimposed over a floorplan 530 of the viewing location of television system 110, as discussed above in conjunction with FIG. 5. For all of the foregoing reasons, the present invention thus provides an improved system and method for effectively determining a physical location of a remote control device.

The invention has been explained above with reference to certain embodiments. Other embodiments will be apparent to those skilled in the art in light of this disclosure. For example, the present invention may readily be implemented using configurations and techniques other than those described in the embodiments above. Additionally, the present invention may effectively be used in conjunction with systems other than those described above. Therefore, these and other variations upon the discussed embodiments are intended to be covered by the present invention, which is limited only by the appended claims.

What is claimed is:

1. A system for effectively performing a location search procedure, comprising:

an electronic device that receives device control information over an RC-device communications link; and a remote control that transmits said device control information over said RC-device communications link, said remote control generating a location indicator in response to a search trigger event, said location indicator being utilized for determining a current physical location of said remote control, said system being capable of performing said location search procedure by alternately selecting and utilizing any of several different search procedures, said several different search procedures including an RF search procedure, an audible search procedure based upon a trigger sound from a system user, and an antenna search procedure during which an antenna assembly transmits an RC location signal and responsively detects an RC return signal from said remote control.

2. The system of claim 1 wherein said electronic device is implemented as a television that is controllable with said remote control.

3. The system of claim 2 wherein said television includes a low/high-speed radio-frequency interface for wireless bi-directional communications, an RC locator control for initiating said location search procedure, and an antenna assembly with two or more physically-separated antennas.

4. The system of claim 3 wherein said television includes a TV memory that stores an RC locator manager with program instructions for managing said location search procedure, and floorplan data representing a local area adjacent to said television for displaying said current physical location of said remote control.

5. The system of claim 2 wherein said television displays an RC-locator GUI to present a graphical representation of said current physical location of said remote control, said RC locator GUI being presented as a plan view of a viewing location of said television, said RC locator GUI including a TV location icon that represents an approximate location of said television, an RC direction vector that shows an approximate current direction of said remote control with reference to said television, and an RC location description that includes written text that specifies a current distance of said remote control from said television.

6. The system of claim 1 wherein said location indicator includes an audible location beacon that is emitted by said remote control.

7. The system of claim 1 wherein said location indicator includes said RC return signal that is transmitted from said remote control to said antenna assembly of said television.

8. The system of claim 1 wherein said search trigger event includes activating an RC locator control, and responsively transmitting an RF trigger signal to said remote control.

9. The system of claim 1 wherein said search trigger event includes detecting an audible trigger by utilizing said remote control.

10. The system of claim 9 wherein said audible trigger includes an audible search command uttered by a system user and detected by a speech recognizer of said remote control.

11. The system of claim 10 wherein said audible trigger includes an audible sound pulse created by a system user and detected by an audio recognition module of said remote control.

12. The system of claim 1 further comprising a charging base that generates said search trigger event, said charging base being freely positionable to facilitate generating said search trigger event.

13. The system of claim 12 wherein said charging base transmits an RF trigger signal directly to said remote control in response to said search trigger event.

14. The system of claim 12 wherein said charging base transmits an RF trigger signal directly to said electronic device in response to said search trigger event, said electronic device responsively relaying said RF trigger signal to said remote control.

15. The system of claim 1 wherein said remote control includes a low/high-speed radio-frequency interface for wireless bi-directional communications, an RC location deactivator for terminating an audible location beacon, and a transducer for receiving an audible trigger and emitting said audible location beacon for said remote control.

16. The system of claim 15 wherein said remote control includes an RC memory that stores an RC locator module with program instructions for managing said location search procedure, an audio recognition module for detecting said audible trigger, and an audio beacon sound file for generating said audible location beacon.

17. The system of claim 1 wherein said location search procedure is performed as said RF search procedure in which a system user initially activates an RC locator control, said electronic device responsively transmitting an RF trigger signal that is received by said remote control via said RC-device communications link, said remote control responsively generating an audible locator beacon to allow said system user to locate said remote control by determining a source location of said audible locator beacon.

18. The system of claim 1 wherein said location search procedure is performed as said audible search procedure for locating said remote control in which a system user initially provides an audible trigger that is detected by said remote control, said audible trigger alternately including a pre-determined verbal command and a sound pulse created by said system user, said remote control responsively generating an audible locator beacon to allow said system user to locate said remote control by determining a source location of said audible locator beacon.

19. The system of claim 1 wherein said location search procedure is performed as said antenna search procedure by utilizing an antenna assembly that includes two or more antennas that are separated by a known separation distance for performing triangulation calculations to locate said remote control, said antenna assembly initially transmitting said RC locator signal to said remote control over said RC-device communications link, said remote control responsively transmitting said RC return signal that is received by said two or more antennas over said RC-device communications link, an RC locator manager then utilizing transmission characteristics from said RC return signal from performing said triangulation calculations to locate said remote control.

20. The system of claim 19 wherein said RC locator manager determines an approximate current location of said remote control by performing said triangulation calculations by utilizing a signal strength of said RC return signal at respective ones of said two or more antennas, and a propagation delay of said RC return signal at said respective ones of said two or more antennas.

21. A method for effectively performing a location search procedure, comprising the steps of:

utilizing an electronic device to receive device control information over an RC-device communications link;

transmitting said device control information from a remote control over said RC-device communications link; and generating a location indicator from said remote control in response to a search trigger event, said location indicator being utilized to determine a current physical location of said remote control, said method being capable of performing said location search procedure by selecting and utilizing any of several different search procedures, said several different search procedures including an RF search procedure, an audible search procedure based upon a trigger sound from a system user, and an antenna search procedure during which an antenna assembly transmits an RC location signal and responsively detects an RC return signal from said remote control.

22. The method of claim 21 wherein said electronic device is implemented as a television that is controllable with said remote control.

23. The method of claim 22 wherein said television includes a low/high-speed radio-frequency interface for wireless bi-directional communications, an RC locator control for initiating said location search procedure, and an antenna assembly with two or more physically-separated antennas.

24. The method of claim 23 wherein said television includes a TV memory that stores an RC locator manager with program instructions for managing said location search procedure, and floorplan data representing a local area adjacent to said television for displaying said current physical location of said remote control.

25. The method of claim 22 wherein said television displays an RC-locator GUI to present a graphical representation of said current physical location of said remote control, said RC locator GUI including a TV location icon that represents an approximate location of said television, said TV location icon being surrounded by concentric rings that represent different distances from said television, said RC locator GUI including an RC direction vector that shows an approximate current direction of said remote control with reference to said television, said RC locator GUI including a remote control location indicator to display said current physical location of said remote control.

26. The method of claim 22 wherein said television displays an RC-locator GUI to present a graphical representation of said current physical location of said remote control, said RC locator GUI being presented as a plan view of a viewing location of said television, said RC locator GUI including a TV location icon that represents an approximate location of said television, an RC direction vector that shows an approximate current direction of said remote control with reference to said television, and an RC location description that includes written text that specifies a current distance of said remote control from said television.

27. The method of claim 21 wherein said location indicator includes an audible location beacon that is emitted by said remote control.

28. The method of claim 21 wherein said location indicator includes said RC return signal that is transmitted from said remote control to said antenna assembly of said television.

29. The method of claim 21 wherein said search trigger event includes activating an RC locator control, and responsively transmitting an RF trigger signal to said remote control.

30. The method of claim 21 wherein said search trigger event includes detecting an audible trigger by utilizing said remote control.

31. The method of claim 30 wherein said audible trigger includes an audible search command uttered by a system user and detected by a speech recognizer of said remote control.

32. The method of claim 31 wherein said audible trigger includes an audible sound pulse created by a system user and detected by an audio recognition module of said remote control.

33. The method of claim 21 further comprising a charging base that generates said search trigger event, said charging base being freely positionable to facilitate generating said search trigger event.

34. The method of claim 33 wherein said charging base transmits an RF trigger signal directly to said remote control in response to said search trigger event.

35. The method of claim 33 wherein said charging base transmits an RF trigger signal directly to said electronic device in response to said search trigger event, said electronic device responsively relaying said RF trigger signal to said remote control.

36. The method of claim 33 wherein said charging base includes a microphone that detects an audible trigger from a system user, said charging base responsively transmitting an RF trigger to said remote control.

37. The method of claim 21 wherein said remote control includes a low/high-speed radio-frequency interface for wireless bi-directional communications, an RC location deactivator for terminating an audible location beacon, and a transducer for receiving an audible trigger and emitting said audible location beacon for said remote control.

38. The method of claim 37 wherein said remote control includes an RC memory that stores an RC locator module with program instructions for managing said location search procedure, an audio recognition module for detecting said audible trigger, and an audio beacon sound file for generating said audible location beacon.

39. The method of claim 21 wherein said location search procedure is performed as said RF search procedure in which a system user initially activates an RC locator control, said electronic device responsively transmitting an RF trigger signal that is received by said remote control via said RC-device communications link, said remote control responsively generating an audible locator beacon to allow said system user to locate said remote control by determining a source location of said audible locator beacon.

40. The method of claim 21 wherein said location search procedure is performed as said audible search procedure for locating said remote control in which a system user initially provides an audible trigger that is detected by said remote control, said audible trigger alternately including a pre-determined verbal command and a sound pulse created by said system user, said remote control responsively generating an audible locator beacon to allow said system user to locate said remote control by determining a source location of said audible locator beacon.

41. The method of claim 21 wherein said location search procedure is performed as said antenna search procedure by utilizing an antenna assembly that includes two or more antennas that are separated by a known separation distance for performing triangulation calculations to locate said remote control, said antenna assembly initially transmitting said RC locator signal to said remote control over said RC-device communications link, said remote control responsively transmitting said RC return signal that is received by said two or more antennas over said RC-device communications link, an RC locator manager then utilizing transmission characteristics from said RC return signal from performing said triangulation calculations to locate said remote control.

42. The method of claim 41 wherein said RC locator manager determines an approximate current location of said remote control by performing said triangulation calculations by utilizing a signal strength of said RC return signal at respective ones of said two or more antennas, and a propagation delay of said RC return signal at said respective ones of said two or more antennas.

43. The method of claim 21 wherein said location search procedure is alternately performed as said RF search procedure, said audible search procedure, and said antenna search procedure.

44. A system for effectively performing a location search procedure, comprising:

means for receiving device control information over an RC-device communications link;

means for transmitting said device control information over said RC-device communications link; and means for generating a location indicator in response to a search trigger event, said location indicator being utilized for determining a current physical location of said means for transmitting, said system being capable of performing said location search procedure by alternately selecting and utilizing any of several different search procedures, said several different search procedures including an RF search procedure, an audible search procedure based upon a trigger sound from a system user, and an antenna search procedure during which an antenna assembly transmits an RC location signal and responsively detects an RC return signal from said means for transmitting.

45. A system for effectively performing a location search procedure, comprising:

a television that receives television control information over an RC-device communications link; and a remote control that transmits said television control information over said RC-device communications link, said remote control generating an audible location beacon in response to a radio-frequency trigger signal transmitted by said television, said radio-frequency trigger signal being requested by a search trigger event when a current physical location of said remote control is unknown, said audible location beacon being utilized for determining said current physical location of said remote control, said system being capable of performing said location search procedure by alternately selecting and utilizing any of several different search procedures, said several different search procedures including an RF search procedure, an audible search procedure based upon a trigger sound from a system user, and an antenna search procedure during which an antenna assembly transmits an RC location signal and responsively detects an RC return signal from said remote control.

46. A system for effectively performing a location search procedure, comprising:

means for transmitting device control information to control an electronic device; and means for generating a location indicator in response to a search trigger event, said location indicator being utilized for determining a current physical location of said means for transmitting, said system being capable of performing said location search procedure by alternately selecting and utilizing any of several different search procedures, said several different search procedures including an RF search procedure, an audible search procedure based upon a trigger sound from a system user, and an antenna search procedure during which an antenna assembly transmits an RC location signal and responsively detects an RC return signal from said means for transmitting.

* * * * *